US008453785B2

(12) United States Patent
Kisse et al.

(10) Patent No.: US 8,453,785 B2
(45) Date of Patent: Jun. 4, 2013

(54) LIFT ARM ASSEMBLY FOR A POWER MACHINE OR VEHICLE

(75) Inventors: Brandon J. Kisse, Fargo, ND (US); Mark F. Bares, West Fargo, ND (US)

(73) Assignee: Clark Equipment Company, West Fargo, ND (US)

( * ) Notice: Subject to any disclaimer, the term of this patent is extended or adjusted under 35 U.S.C. 154(b) by 1833 days.

(21) Appl. No.: 11/692,582

(22) Filed: Mar. 28, 2007

(65) Prior Publication Data

US 2008/0236953 A1 Oct. 2, 2008

(51) Int. Cl.
*B66F 9/075* (2006.01)

(52) U.S. Cl.
USPC ..... 180/311; 403/119; 414/686; 180/905

(58) Field of Classification Search
USPC ... 180/311, 312, 905, 906; 280/781; 414/686, 414/722; 403/119, 154, 155, 161, 162, 288, 403/319; 301/131, 132; 384/91, 276, 295, 384/428; 52/111, 116, 653.1; 248/288.11, 248/291.1
See application file for complete search history.

(56) References Cited

U.S. PATENT DOCUMENTS

| | | | | |
|---|---|---|---|---|
| 2,502,681 | A | 4/1950 | Swanson | 37/410 |
| D159,160 | S | 6/1950 | Mork | |
| 3,342,362 | A | 9/1967 | Stefanutti | 414/709 |
| 3,520,118 | A * | 7/1970 | Lausch et al. | 56/10.7 |
| 3,633,383 | A * | 1/1972 | Kleinschmidt | 464/16 |
| 3,635,365 | A * | 1/1972 | Bauer | 414/715 |
| 3,725,996 | A | 4/1973 | Skanes et al. | |
| 3,791,705 | A | 2/1974 | Schimel | 308/15 |
| 5,169,278 | A | 12/1992 | Hoechst et al. | |
| 5,609,464 | A | 3/1997 | Moffitt et al. | |
| 6,098,739 | A | 8/2000 | Anderson et al. | |
| 6,108,907 | A | 8/2000 | Anderson et al. | |
| 6,109,858 | A | 8/2000 | Deneve et al. | |
| 6,325,589 | B1 | 12/2001 | Jang et al. | |
| 6,575,262 | B2 | 6/2003 | Nagatsuka | |
| 6,616,398 | B2 | 9/2003 | Dershem et al. | |
| D492,327 | S | 6/2004 | Albright et al. | |
| 2003/0175105 | A1 | 9/2003 | Hilvers et al. | |
| 2004/0228715 | A1 | 11/2004 | Roan et al. | 414/680 |
| 2006/0251349 | A1 * | 11/2006 | Schmeling et al. | 384/91 |

FOREIGN PATENT DOCUMENTS

| | | |
|---|---|---|
| EP | 0474210 | 4/1991 |
| GB | 2419341 | 4/2006 |

OTHER PUBLICATIONS

"Couple" definition, Dictionary.com, available at, http://dictionary.reference.com/browse/couple (last visited at Aug. 23, 2012).*
Communication dated Dec. 29, 2010 from the European Patent Office in Application No. 08 726 952.8.

(Continued)

*Primary Examiner* — Joseph Rocca
(74) *Attorney, Agent, or Firm* — Dierdre Megley Kvale; Westman, Champlin & Kelly, P.A.

(57) ABSTRACT

The application discloses embodiments of a universal pinning system for lift arms of a power machine or vehicle. In embodiments disclosed, the universal pinning system includes a universal shaft. Lift arms are coupled to the universal shaft to provide a common pivot axis for the lift arms. The universal shaft is coupled to a frame or support of the power machine or vehicle via a pinning assembly. As disclosed, the universal pinning system has application for radial lift arms operable along a radial path or vertical lift arms operable along a vertical path.

15 Claims, 10 Drawing Sheets

OTHER PUBLICATIONS

Communication dated Apr. 26, 2011 for Chinese application No. 200880010073.1, filed Mar. 19, 2008, with English translation of details.
Chinese Office Action dated Apr. 1, 2012 from Chinese Patent Application No. 200880010073.1, filed Mar. 19, 2008.
"Notification of Transmittal of the International Search Report and the Written Opinion of the International Searching Authority, or the Declaration" for PCT/US2008/003567 filed Mar. 19, 2008; 16 pages.
Communication from the European Patent Office dated Oct. 7, 2011 for European application No. 08 726 952.8, filed Mar. 19, 2008.

* cited by examiner

LIFT ARM ASSEMBLY FOR A POWER MACHINE OR VEHICLE

BACKGROUND

Power machines or vehicles, such as loaders or other machines, include a lift arm assembly that is used to raise, lower and/or position an attachment or implement. Typically, lift arms of a lift arm assembly are pinned to a frame portion of the power machine or vehicle so that the lift arms rotate to raise and/or lower the implement or attachment for use. Lift arms of a lift arm assembly can have a vertical or radial lift path depending upon the structure of the lift arms. For operation, each of a plurality of lift arms of a radial lift arm assembly or vertical lift arm assembly should move in unison to limit twisting or other motion. In prior assemblies, the plurality of lift arms are pinned to separate frame portions to form separate pivot axes for each of the lift arms. Without additional structural support, separate pivot axes can introduce twisting or other motion. The discussion above is merely provided for general background information and is not intended to be used as an aid in determining the scope of the claimed subject matter.

SUMMARY

Embodiments of the present invention relate to a universal pinning system for lift arms of a power machine or vehicle. In embodiments disclosed, the universal pinning system includes a universal shaft. Lift arms are coupled to the universal shaft to provide a common pivot axis for the lift arms. The universal shaft is coupled to a frame or support of the power machine or vehicle via a pinning assembly. As disclosed, the universal pinning system has application for radial lift arms operable along a radial path or vertical lift arms operable along a vertical path.

The Summary and Abstract are provided to introduce a selection of concepts in a simplified form that are further described below in the Detailed Description. The Summary and Abstract are not intended to identify key features or essential features of the claimed subject matter, nor are they intended to be used as an aid in determining the scope of the claimed subject matter. In addition, the claimed subject matter is not limited to implementations that solve any or all aspects noted in the background.

DETAILED DESCRIPTION OF ILLUSTRATIVE EMBODIMENTS

Figure 1A:
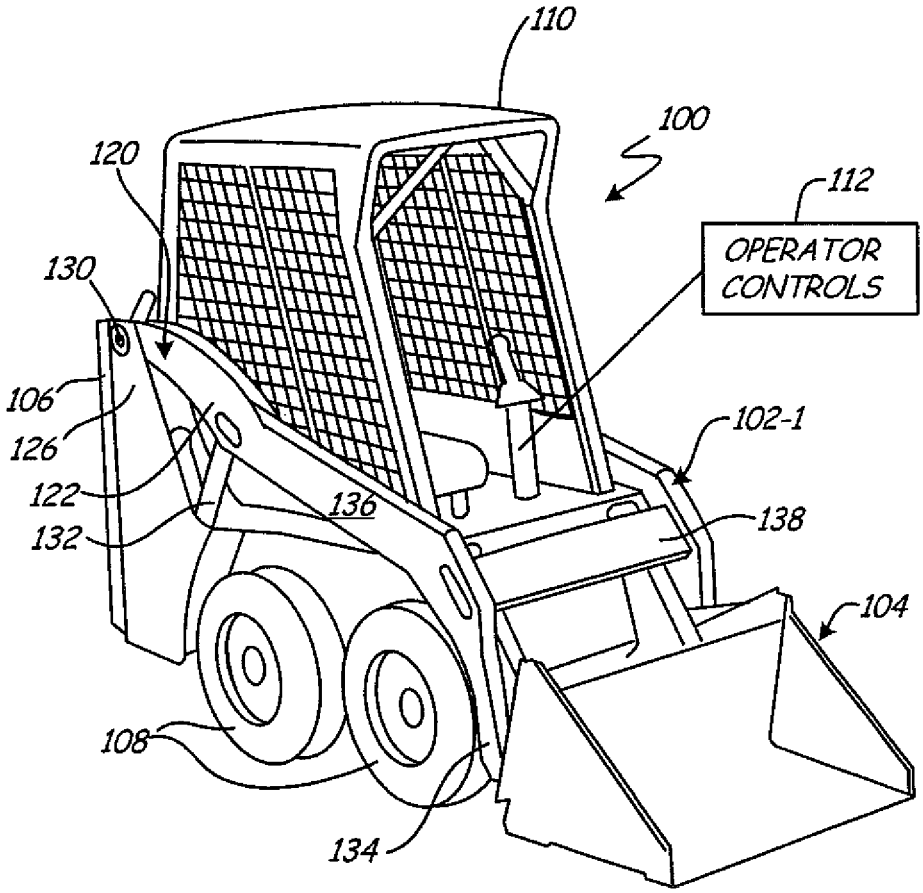
FIG. 1A illustrates an embodiment of a power machine having a radial lift arm assembly.
Figure 1B:
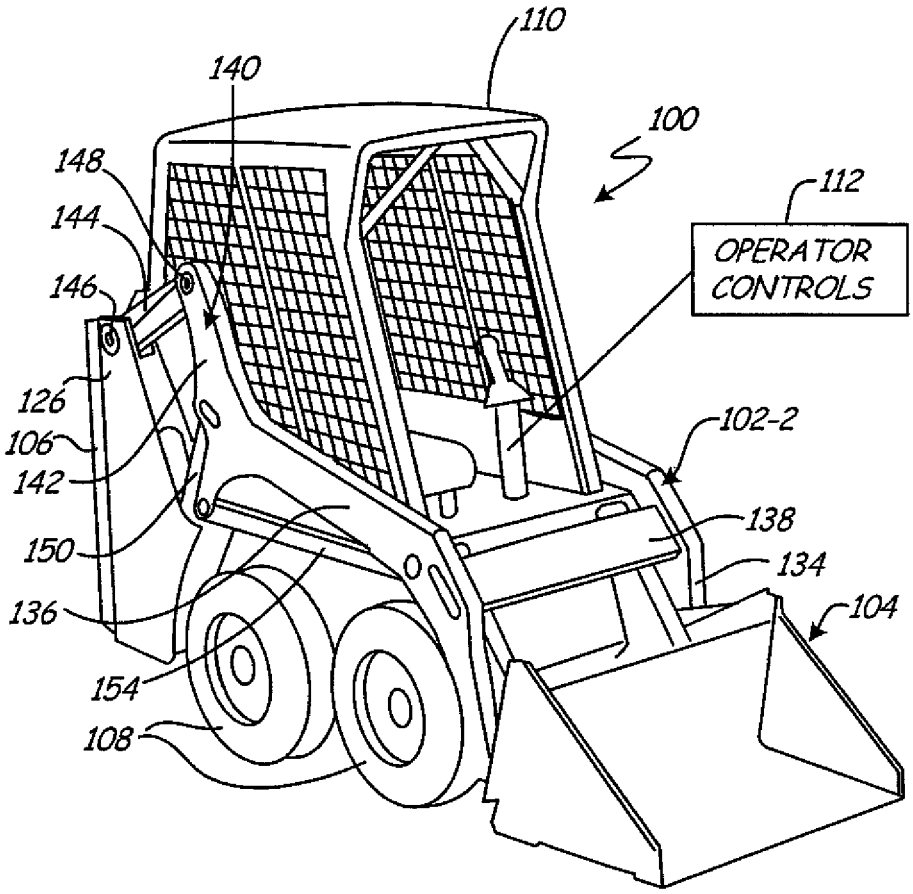
FIG. 1B illustrates an embodiment of a power machine having a vertical lift arm assembly.

FIGS. 1A and 1B illustrate embodiments of a power machine or vehicle 100 having different lift arm assemblies 102-1, 102-2 to support an attachment or implement 104. In each of the illustrated embodiments, the lift arm assemblies 102-1, 102-2 are coupled to the frame 106 of the vehicle or power machine 100 to raise and/or lower the implement or attachment 104 coupled to the lift arm assembly 102-1 or 102-2. In the illustrated embodiments, wheels 108 are coupled to the power machine to drive the machine or vehicle over ground. Alternatively, the machine can be driven via a track assembly coupled to the frame 106 as illustrated herein. In the illustrated embodiments, the implement 104 shown is a bucket, however, different implements or attachments can be coupled to the lift arm assemblies and application is not limited to a particular attachment or implement.

As shown in FIGS. 1A and 1B, the illustrated power machine or vehicle 100 includes an operator cab 110 supported relative to frame 106 of the vehicle. The cab 110 includes via various operating controls 112 (illustrated schematically) to drive or operate the vehicle. The operating controls 112 include controls for operating the lift arm assembly 102-1 or 102-2 to raise, lower and/or orient the implement or attachment 104 coupled to the lift arm assembly 102-1 or 102-2. In an alternate embodiment, the operating controls 112 can be remote from the vehicle and application is not limited to operation of the machine or vehicle from cab 110.

In the embodiment illustrated in FIG. 1A, the lift arm assembly 102-1 includes a plurality of radial lift arms 120 (only one visible in FIG. 1A) having radial arm portions 122 to form radial lift arm assembly 102-1. The radial arm portions 122 are rotationally coupled to upright frame portions 126 (only one visible in FIG. 1A) on a body of the power machine and rotate about pivot axis 130. The lift arm portions 122 are rotated about pivot axis 130 via operation of hydraulic cylinders 132 or other actuator device to raise and/or lower the radial lift arms 120. Hydraulic cylinders 132 are coupled to the radial arm portions 122 to supply a lift force to rotate the radial arm portions 122 about the pivot axis 130 to move the radial lift arms 120 along a radial lift path. The radial lift arms 120 also include knee portions 134 which are contoured to position the implement coupled thereto proximate to the ground when the lift arms 120 are in the lowered position. Intermediate portions 136 extend between the radial arm portions 122 and the knee portions 134 to form the radial lift arms 120 of the radial lift arm assembly 102-1. As shown, cross beam 138 extends between knee portions 134 of the radial lift arms 120 to provide structural rigidity.

In the embodiment illustrated in FIG. 1B, the lift arm assembly 102-2 includes a plurality of vertical lift arms 140 (only one visible in FIG. 1B) having vertical arm portions 142 and link portions 144 which cooperatively form the vertical lift arms 140 of the vertical lift arm assembly 102-2. The link portions 144 are rotationally coupled to upright frame portions 126 to provide a first pivot axis 146 and each of the vertical arm portions 142 is rotationally coupled to link portions 144 to provide a second pivot axis 148 spaced from the first pivot axis 146. The multiple or first and second pivot axes 146, 148 provide a vertical lift path to raise and/or lower implement 104.

The plurality of lift arms 140 include knee portions 134 having an implement coupleable thereto and intermediate portions 136 that extend between the vertical arm portions 142 and knee portions 134. As shown, cross beam 138 extends between knee portions 134 of the lift arms 140 to provide structural rigidity. Hydraulic cylinders 150 (only one visible in FIG. 1B) are coupled to the vertical arm portions 142 to supply a lift force to arm portions 142 to rotate each of the lift arms about the second axis 148. A tie rod 154 is connected between an extension of the vertical arm portions 142 and the frame 106 to limit rotation of the lift arms 140 about the second pivot axis 148. Once the lift arms 140 reach a rotation limit of the second pivot axis 148, further application of lift force rotates link portions 144 about the first pivot axis 146 to provide a generally vertical lift path for the vertical lift arms 140 as is known in the art.

Figure 2:
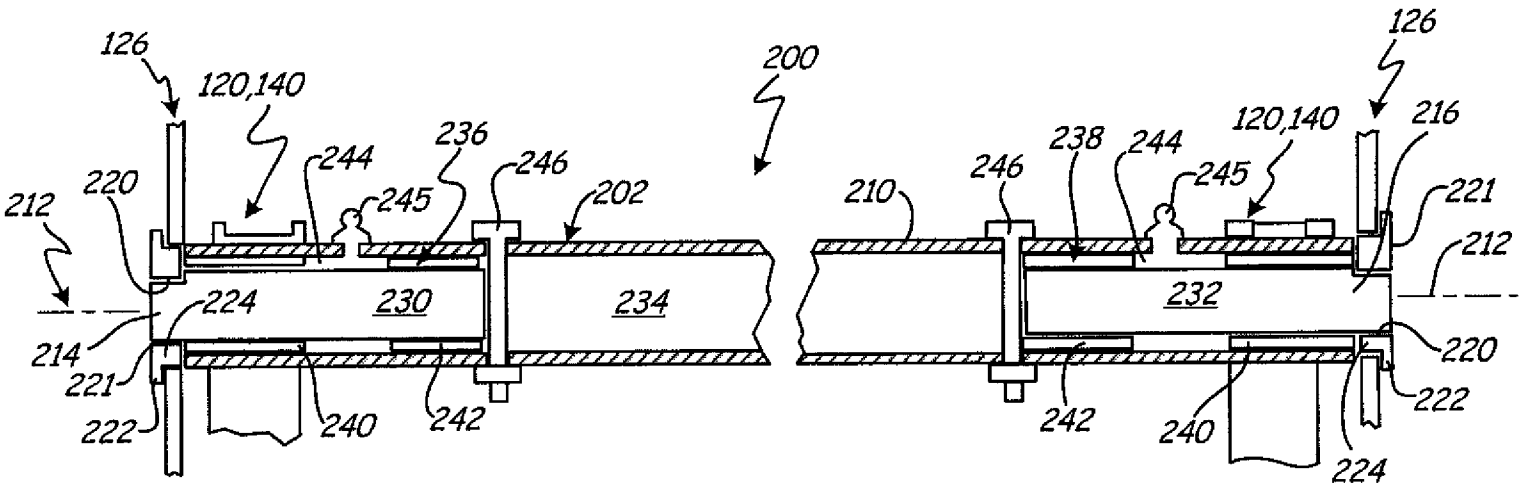
FIG. 2 schematically illustrates an embodiment of a pinning system to pin lift arms to frame portions of a power machine or vehicles through a universal shaft and pinning assembly.
Figure 3:
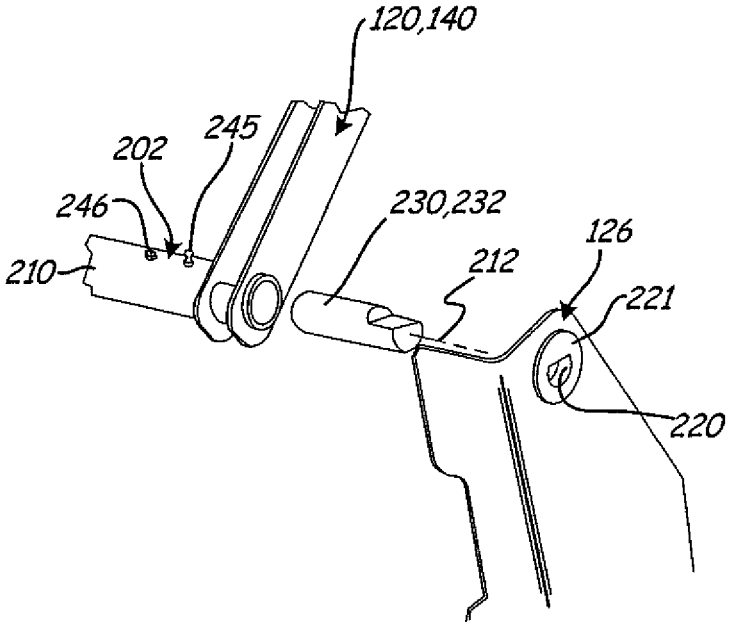
FIG. 3 is an exploded view of one side of the pinning system illustrated in FIG. 2.

Typically, the lift arms illustrated in FIGS. 1A and 1B are rotationally coupled to upright frame portions 126 via a pinning system. FIGS. 2 and 3 illustrate an embodiment of a universal pinning system 200 having application for both radial and vertical lift arms or assemblies illustrated in FIGS. 1A and 1B. In the illustrated embodiment, the universal pinning system 200 includes a universal shaft 202 and pinning assembly. Only a portion of universal shaft 202 is illustrated in FIG. 3. As shown, the universal shaft 202 has a length that extends between spaced upright frame portions 126 of the power machine (not shown in FIGS. 1A-1B). The plurality of lift arms 120, 140 of the lift arm assemblies 102-1, 102-2 are coupled to the universal shaft 202 and are rotatable therewith to define a common pivot axis 212 for the plurality of lift arms 120, 140.

In the embodiment illustrated in FIGS. 2-3, the universal shaft 202 includes an outer tube 210 having the lift arms 120, 140 coupled thereto. The outer tube 210 is rotationally coupled to a pinning assembly to rotate the lift arms 120, 140 about the common pivot axis 212. As shown in FIG. 2, the pinning assembly includes opposed pins 214, 216 that extend from opposed ends of the universal shaft 202 and are sized for insertion into pin openings 220 on the upright frame portions 126. As shown in FIG. 2, pins 214, 216 of the pinning assembly are inserted into pin openings 220 formed in a bushing 221 secured to the upright frame portions 126. In the illustrated embodiment, the bushing 221 includes a flange portion 222, a sleeve portion 224 and forms the pin opening 220 to connect the universal shaft 202 to the upright frame portions 126.

In the illustrated embodiment, the pinning assembly includes a plurality of cylindrical bodies 230, 232 that are disposed in an inner channel 234 of the outer tube 210. A portion of the cylindrical bodies 230 232 extends outwardly from the outer tube 210 to form the pins 214, 216 that connect the universal shaft 202 to the frame. The outer tube 210 is rotationally coupled to the plurality of cylindrical bodies 230, 232 of the pinning assembly via spaced bushing assemblies 236, 238. Each of the bushing assemblies 236, 238 includes first and second sleeves 240, 242 separated by a lubricant fill area 244. The lubricant fill area is filled via tap 245. Thus, as described, the outer tube 210 is rotationally coupled to pins 214, 216 for rotation of the plurality of lift arms 120, 140 about the common pivot axis 212. Traverse or inward movement of the cylindrical bodies 230, 232 of the pinning assembly are restricted via cross bolts 246 inserted through the outer tube 210.

Figure 4:
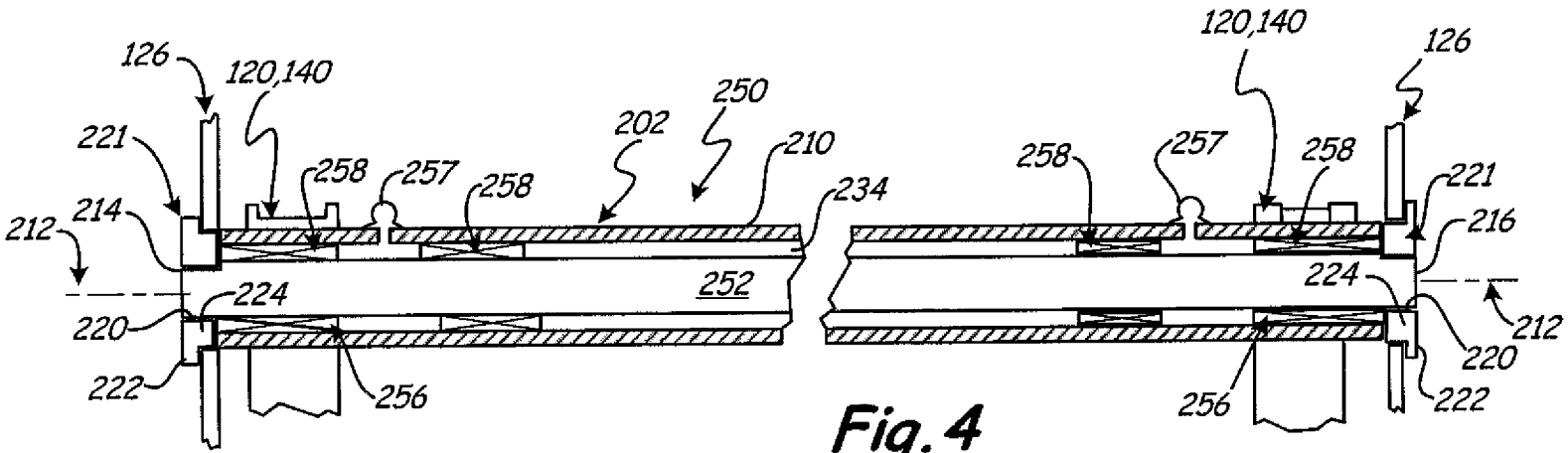
FIG. 4 schematically illustrates another embodiment of a pinning system including a universal shaft.

FIG. 4 illustrates another embodiment of a pinning system where like numbers refer to like parts in the previous FIGS. In the embodiment illustrated in FIG. 4, the pinning system 250 includes universal shaft 202. As shown, the universal shaft 202 includes outer tube 210 having an elongate cylindrical body 252 that extends through the inner channel 234 of the outer tube 210. End portions of the cylindrical body form opposed pins 214, 216 that connect the universal shaft 202 to the upright frame portions 126. End portions or pins 214, 216 are inserted into openings 220 or bushings 221 in the upright frame portions 126 to connect the universal shaft 202 to the upright frame portions 126. Illustratively, the cylindrical body 252 can be formed of multiple collapsible segments to facilitate insertion of the end portions or pins 214, 216 of the cylindrical body 252 into the openings or bushings 221 of the upright frame portions 126.

In illustrated embodiments, opposed ends of the universal shaft 202 are connected to upright frame portions 126 on opposed sides of the power machine through bushings 221. Since both lift arms 120, 140 are connected to the universal shaft 202 and the universal shaft 202 is connected to the upright frame portions 126, only two bushings are employed to connect the lift arms 120, 140 to the power machine, instead of four bushings previously used to connect the plurality of lift arms 120, 140 to the upright frame portions 126 of the power machine.

As diagrammatically illustrated at blocks 256, the outer tube 210 is rotationally coupled to the elongate cylindrical body 252 to define the common pivot axis 212 to raise and/or lower the plurality of lift arm 120, 140. Illustratively, the outer tube 210 is rotationally coupled to the elongate cylindrical body 252 via a bushing assembly or other rotational coupling or bearing. In the illustrated embodiment a grease fitting or area 257 is interposed between bushing segments or sleeves 258 that rotationally connect the outer tube 210 to the cylindrical body 252, as previously described with respect to FIG. 2.

Figure 5:
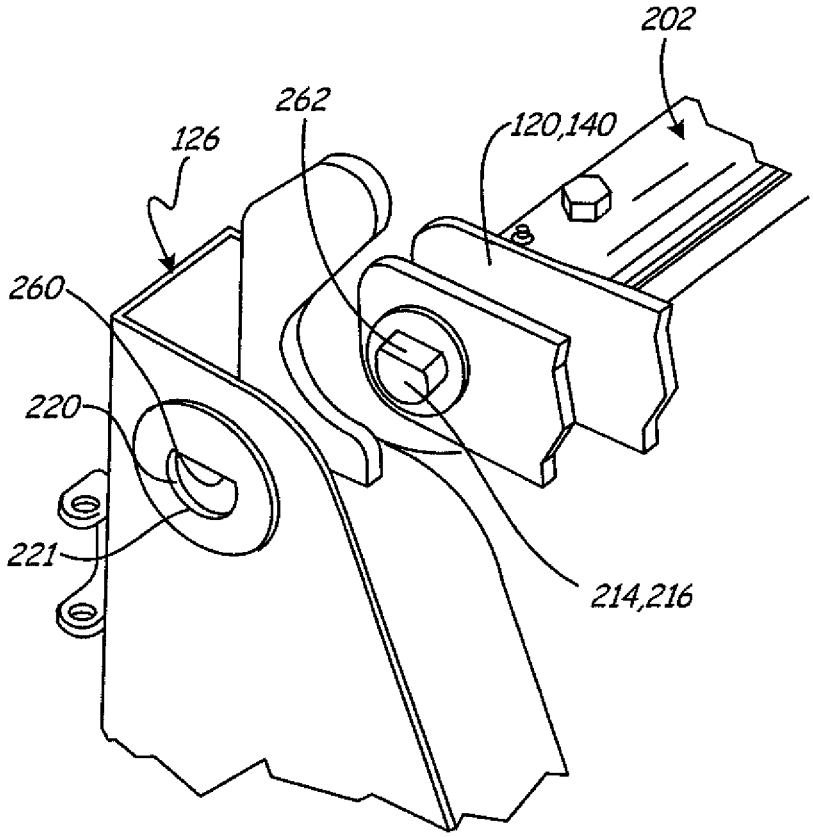
FIG. 5 illustrates one side of a pinning system including a universal shaft and pin insertable into a pin opening or bushing on an upright frame portion.

FIG. 5 illustrates an interface between pins 214, 216 and pin openings 220 on upright frame portions 126 previously illustrated in FIGS. 2-4. As shown in FIG. 5, an inner circumference of the bushing 221 on the upright frame portion 126 includes a flat surface 260. Similarly, an end portion of the pins 214, 216 includes a cutout portion forming flat surface 262 along an outer circumference of the pins 214, 216. The flat surface 262 of the pins 214, 216 interfaces with the flat surface 260 of the bushing 221 to restrict rotation of the pins 214, 216 relative to the frame portions 126 so that the outer tube 210 rotates about the common pivot axis 212 to raise and/or lower the lift arms of a lift arm assembly.

Although FIGS. 2-5 illustrate a particular pinning assembly, application is not limited to the particular pinning assembly shown. For example, application is not limited to a pinning assembly including flat surface 260 on bushing 221 and flat surface 262 on pins 214, 216 as shown. In alternate embodiments the pins 214, 216 are secured to the bushings 221 via a cross bolt, or a welded or bolted ear connection as an alternative to the flat surfaces 260, 262 on the pins 214, 216 and bushing 221.

Figure 6:
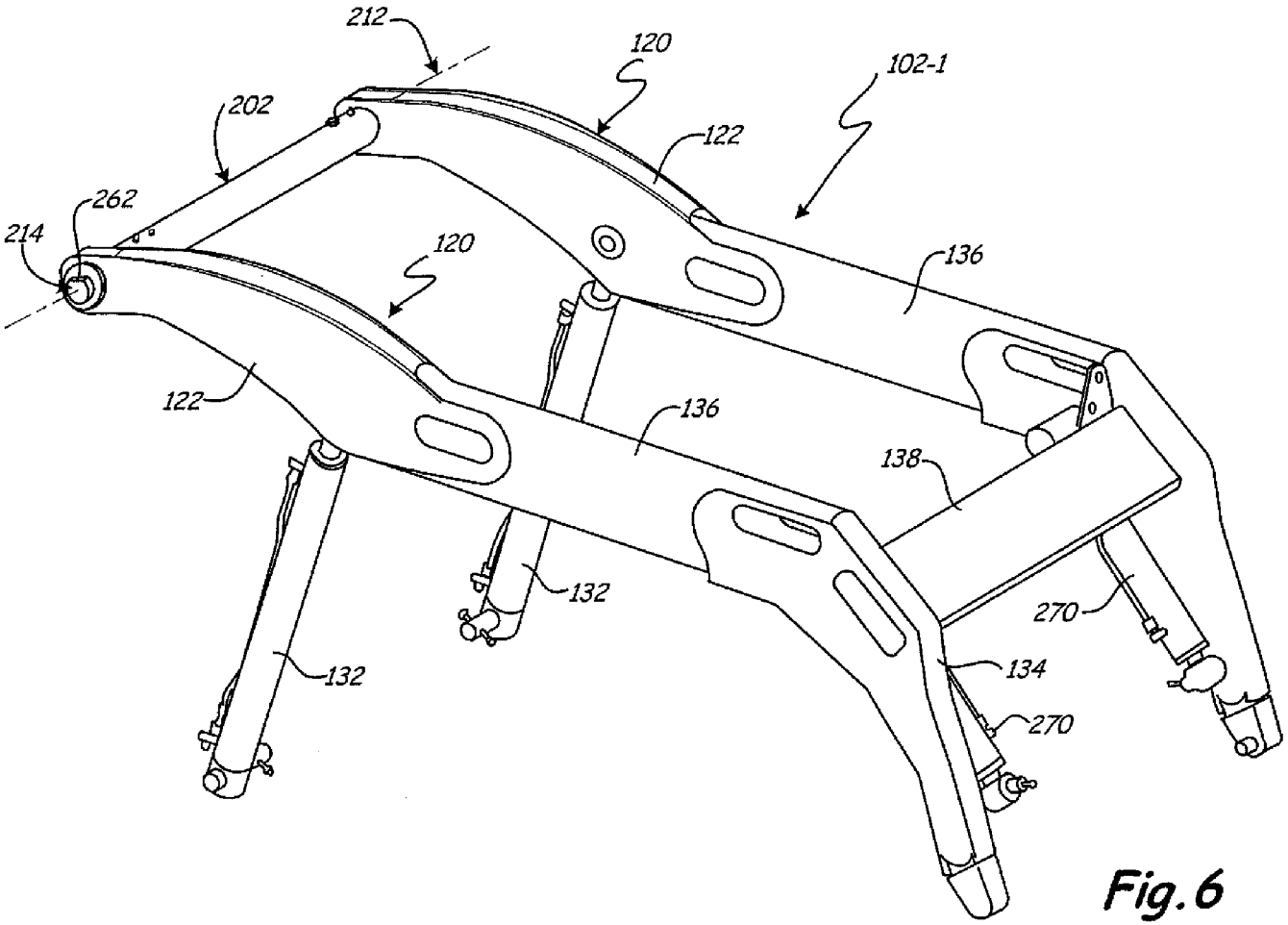
FIG. 6 illustrates an embodiment of a radial lift arm assembly including a pinning system having a universal shaft and pinning assembly.

FIG. 6 illustrates an embodiment of a radial lift arm assembly 102-1 including a universal shaft 202 and pinning assembly as previously described, where like numbers are used to refer to like parts in the previous FIGS. As shown, the radial arm portions 122 of the radial lift arms 120 are connected to the universal shaft 202 coupled to the upright frame portions 126 (not shown in FIG. 6) via the pinning assembly. As shown, hydraulic cylinders 132 are coupled to the radial arm portions 122 to supply a lifting force to rotate the universal shaft 202 about the common pivot axis 212 (which forms the pivot axis 130) to raise and/or lower the plurality of lift arms 120. As shown, tilt cylinders 270 are coupled to the knee portions 134 of the plurality of lift arms 120 to adjust an orientation or tilt of an implement or attachment (not shown in FIG. 6).

Figure 7:
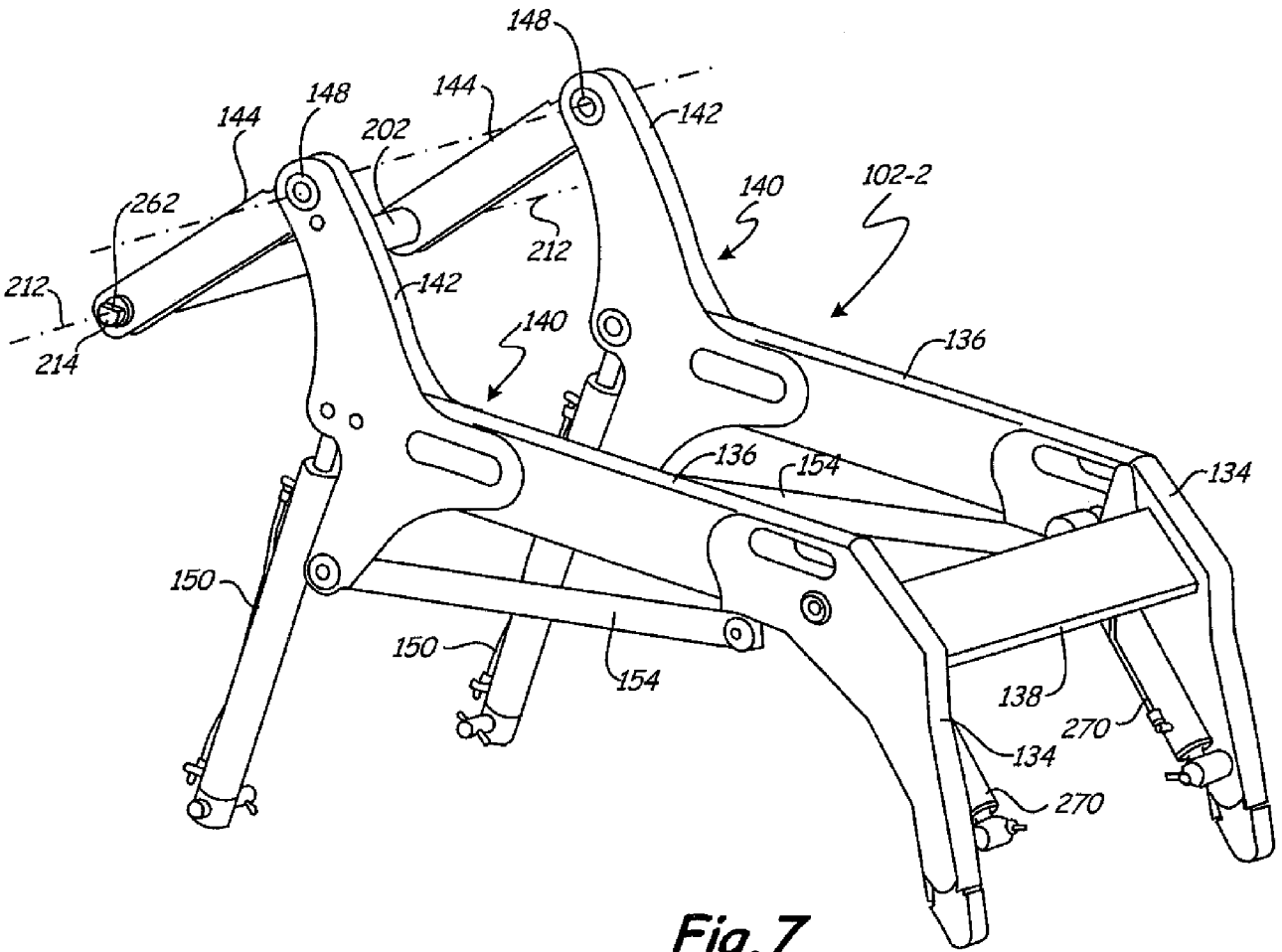
FIG. 7 illustrates an embodiment of a vertical lift arm assembly including a pinning system having a universal shaft and pinning assembly.

FIG. 7 illustrates an embodiment of a vertical lift arm assembly including a universal shaft 202 and pinning assembly. As shown, the vertical lift arms 140 include vertical arm portions 142 and link portions 144 as previously described. The link portions 144 are coupled to the universal shaft 202 as shown and are rotatable about common axis pivot 212 (which forms the first pivot axis 146 for the link portions 144) of the vertical lift arm assembly. Hydraulic actuators or cylinders 150 are coupled to the vertical arm portions 142 to rotate the vertical arm portions 142 about pivot axis 148 as previously described. Tie rods 154 are connected to a tie rod extension of the vertical arm portions 142 and the frame 106 (not shown in FIG. 7) to limit rotation of the arm portions 142 relative to pivot axis 148. As previously described, tie rods 154 restrict rotation of the vertical arm portions 142 about the pivot axes 148 and thus, further application of lift force rotates the universal shaft 202 about the common pivot axis 212 to provide a vertical lift path for the lift arm assembly 102-2 of FIG. 7.

Figure 8:
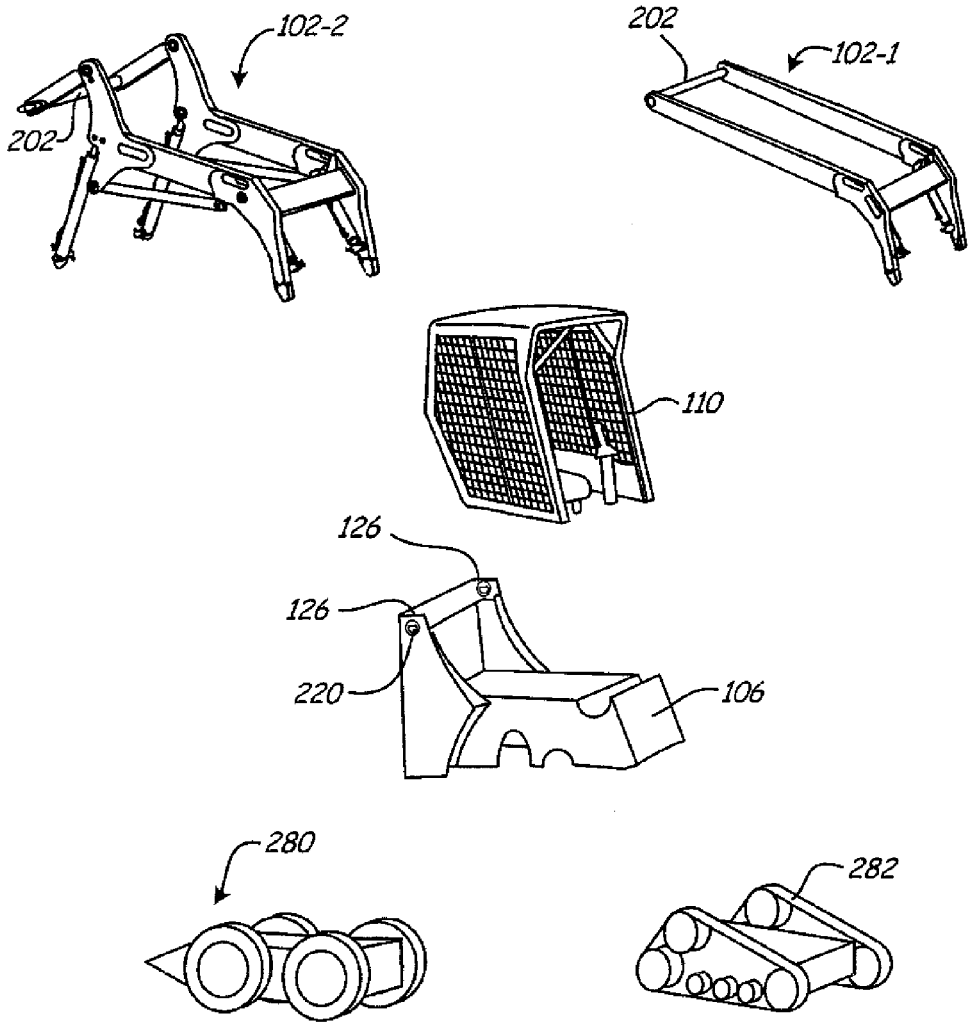
FIG. 8 is an exploded illustration of assembly components of the power machine or vehicle.

The universal pinning system described herein has applications for a modular machine construction for radial or vertical lift applications. FIG. 8 illustrates a modular construction incorporating a universal pinning system for radial or vertical lift arm applications. As shown, the modular construction includes frame 106 and cab 110. Cab 110 is assembled to frame 106. Frame 106 includes upright frame portions 126. As shown, the universal shaft 202 of either the radial lift arm assembly 102-1 or vertical lift arm assembly 102-2 lift is assembled to frame 106 depending upon preference, since the shaft 202 is universally connectable to the frame portions 126. As shown, either a wheel chassis 280 or track chassis 282 can be coupled to the frame 106 depending upon preference.

Figure 9:
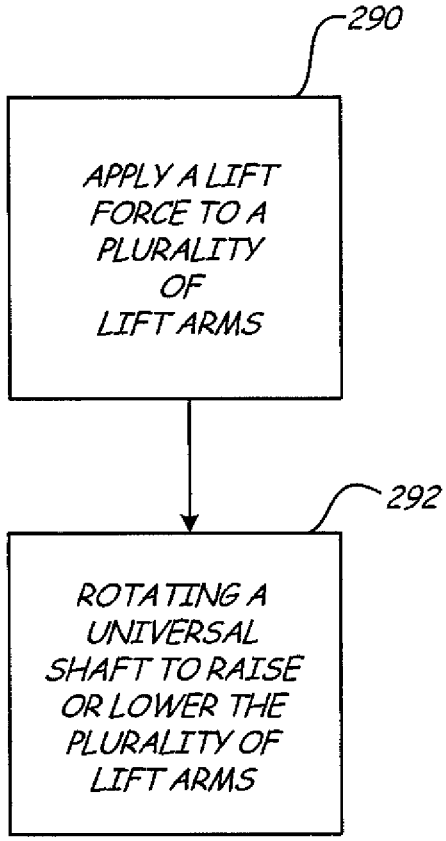
FIG. 9 is a flow chart illustrating steps of operation for a lift arm assembly coupled to a power machine or vehicle through a universal pinning system.

FIG. 9 illustrates steps for operation of a lift arm assembly according to embodiments of the present invention. As shown in step 290, a lift force is supplied to the plurality of lift arms to raise or lower the lift arms. The plurality of lift arms refers to both radial lift arms and vertical lift arms as described herein. In illustrated embodiments, the lift force is supplied to the plurality of lift arms via operation of hydraulic cylinders coupled to the plurality of lift arms. In step 292, a universal shaft 202 is rotated to raise or lower the plurality of lift arms. In illustrated embodiments, the plurality of lift arms are coupled to the universal shaft 202, which is rotatable about a common pivot axis 212, as described. The application of the lift force to the plurality of lift arms rotates the universal shaft 202 about the common pivot axis 212 to raise or lower the plurality of lift arms coupled thereto as described.

Although the present invention has been described with reference to preferred embodiments, workers skilled in the art will recognize that changes may be made in form and detail without departing from the spirit and scope of the invention. For example application is not limited to the radial or vertical lift arm assemblies shown.

What is claimed is:

1. A lift arm assembly configured to be attached to a frame of a power machine, comprising:

a shaft wherein the shaft includes an outer tube rotationally coupled to a pinning assembly, wherein the pinning assembly includes first and second pins extending from opposed ends of the shaft to connect the shaft to the frame, wherein the first and second pins include a flat surface configured to interface with a flat surface of pin openings on the frame and restrict rotation of the first and second pins relative to the frame; and a plurality of lift arms coupled to the outer tube of the shaft.

2. The lift arm assembly of claim 1 wherein the pinning assembly includes at least one cylindrical body disposed in an inner channel of the outer tube and the outer tube is rotationally coupled to the at least one cylindrical body.

3. The lift arm assembly of claim 1 wherein the pinning assembly includes a first cylindrical body and a second cylindrical body disposed in an inner channel of the outer tube and the outer tube is rotationally coupled to the first and second cylindrical bodies to rotate the plurality of lift arms about a common pivot axis.

4. The lift arm assembly of claim 3 wherein the outer tube is rotationally coupled to the first cylindrical body through a first bushing assembly and the outer tube is rotationally coupled to the second cylindrical body through a second bushing assembly.

5. The lift arm assembly of claim 4 wherein the first and second bushing assemblies include a first bushing sleeve and a second bushing sleeve spaced from the first bushing sleeve and a lubricant space between the first and second bushing sleeves.

6. The lift arm assembly of claim 3 including a cross bolt extending through the outer tube proximate to the first and second cylindrical bodies to restrict inward movement of the first and second cylindrical bodies along the inner channel of the outer tube.

7. The lift arm assembly of claim 1 wherein first and second cylindrical bodies extend outwardly from the opposed ends of the outer tube to form the first and second pins extending from opposed ends of the shaft and the first and second pins include the flat surface configured to interface with the flat surface of the pin openings on the frame and restrict rotation of the first and second pins relative to the frame.

8. The lift assembly of claim 1 wherein the plurality of lift arms are selected from one of a plurality of radial lift arms operable along a radial lift path and a plurality of vertical lift arms operable along a vertical lift path.

9. The lift arm assembly of claim 1 wherein the flat surface is formed along an outer circumference of the first and second pins.

10. A power machine comprising:

a frame including a plurality of upright frame portions;

a lift arm assembly, including:

a shaft coupled to the upright frame portions;

a pinning assembly configured to pin a plurality of lift arms coupled to the shaft to the upright frame portions through the shaft, wherein the shaft includes an outer tube rotationally coupled to the pinning assembly; and an actuator that is coupled to the frame and the lift arm assembly.

11. The power machine of claim 10 wherein the pinning assembly includes first and second pins extending from opposed ends of the shaft and the first and second pins include a flat surface which interfaces with a flat surface of a pin opening on the upright frame portions to restrict rotation of the first and second pins relative to the upright frame portions.

12. The power machine of claim 10 wherein the pinning assembly includes at least one cylindrical body disposed in an inner channel of the outer tube and the outer tube is rotationally coupled to the at least one cylindrical body.

13. The power machine of claim 10 wherein the pinning assembly includes a plurality of cylindrical bodies disposed in an inner channel of the outer tube and the outer tube is rotationally coupled to the plurality of cylindrical bodies.

14. The power machine of claim 10 wherein the power machine includes a first bushing connecting a first end of the shaft to a first upright frame portion on a first side of the power machine and a second bushing connecting a second end of the shaft to a second upright frame portion on a second side of the power machine.

15. The power machine of claim 14 wherein the power machine comprises fewer than four bushings to connect the plurality of lift arms to the plurality of upright frame portions.

* * * * *